US011619078B2

(12) United States Patent
Rosales

(10) Patent No.: US 11,619,078 B2
(45) Date of Patent: Apr. 4, 2023

(54) MOTOR VEHICLE LOCK

(71) Applicant: Brose Schliesssysteme GmbH & Co. Kommanditgesellschaft, Wuppertal (DE)

(72) Inventor: David Rosales, Rochester Hills, MI (US)

(73) Assignee: Brose Schliesssysteme GmbH & Co. Kommanditgesellschaft, Wuppertal (DE)

( * ) Notice: Subject to any disclaimer, the term of this patent is extended or adjusted under 35 U.S.C. 154(b) by 655 days.

(21) Appl. No.: 16/039,851

(22) Filed: Jul. 19, 2018

(65) Prior Publication Data

US 2020/0024874 A1 Jan. 23, 2020

(51) Int. Cl.
*E05B 81/20* (2014.01)
*E05B 81/14* (2014.01)
(Continued)

(52) U.S. Cl.
CPC ..... *E05B 81/20* (2013.01); *E05B 81/14* (2013.01); *E05B 81/21* (2013.01); *E05B 79/20* (2013.01); *E05B 81/90* (2013.01); *E05B 83/36* (2013.01)

(58) Field of Classification Search
CPC ..... E05B 81/20; E05B 81/14; E05B 79/20; E05B 81/90; E05B 83/36; E05B 81/21;
(Continued)

(56) References Cited

U.S. PATENT DOCUMENTS 4,927,196 A * 5/1990 Girard ..... E05B 15/0046 292/216
6,422,615 B1 * 7/2002 Roos ..... E05B 81/20 292/201
(Continued)

FOREIGN PATENT DOCUMENTS

DE 10049895 A1 * 4/2002 ..... E05B 81/20
DE 10123187 11/2002
(Continued)

OTHER PUBLICATIONS

Espacenet, Machine translation of EP 0133508 A1, generated Nov. 18, 2022 (Year: 2022).*
(Continued)

*Primary Examiner* — Kristina R Fulton
*Assistant Examiner* — Emily G. Brown
(74) *Attorney, Agent, or Firm* — Pauly, DeVries Smith & Deffner LLC

(57) ABSTRACT

A motor vehicle lock has a pawl and a catch that may be moved into an open position, a preliminary latching position and a main latching position. In one of the latching positions, the catch is or may be brought into holding engagement with a lock striker. In the installed state, during a cinching routine, the catch is moved into its main latching position by a cinching drive. A spring biased freewheel mechanism, which is limited to a freewheel distance, is provided between the cinching drive and the catch. With the reaction force of the catch exceeding a predefined level, the cinching drive freewheels with respect to the catch against the spring bias of the freewheel mechanism, until the freewheel distance is reached and the freewheel mechanism is interlocked for force transmission.

16 Claims, 6 Drawing Sheets

(51) Int. Cl.
*E05B 83/36* (2014.01)
*E05B 79/20* (2014.01)
*E05B 81/90* (2014.01)

(58) Field of Classification Search
CPC ..... E05B 81/00; E05B 81/04; E05B 81/22; E05B 17/0029; Y10T 292/1047; Y10T 272/1082; Y10S 292/23
See application file for complete search history.

(56) References Cited

U.S. PATENT DOCUMENTS

| | | | | |
|---|---|---|---|---|
| 6,964,438 | B2 | 11/2005 | Koike et al. | |
| 7,111,878 | B2 * | 9/2006 | Kachouh | E05B 81/14 292/201 |
| 7,261,334 | B2 * | 8/2007 | Oberheide | E05B 81/14 292/201 |
| 7,380,844 | B2 * | 6/2008 | Berghahn | E05B 81/20 292/201 |
| 8,807,807 | B2 * | 8/2014 | Wheeler | E05B 1/0092 362/501 |
| 9,874,046 | B2 * | 1/2018 | Wittelsbuerger | E05B 85/243 |
| 10,005,498 | B2 * | 6/2018 | Rosales | B62D 33/037 |
| 2006/0048451 | A1 * | 3/2006 | Fukumura | E05B 81/70 49/360 |
| 2009/0151257 | A1 * | 6/2009 | Dominique | E05B 81/66 49/280 |
| 2017/0130490 | A1 * | 5/2017 | Wirths | E05B 85/107 |
| 2019/0145135 | A1 * | 5/2019 | Lebsak | E05B 81/20 292/229 |
| 2020/0024875 | A1 | 1/2020 | Rosales | |
| 2020/0040618 | A1 | 2/2020 | Bendel | |
| 2021/0017794 | A1 * | 1/2021 | Drost | E05B 81/21 |
| 2021/0230911 | A1 | 7/2021 | Weichsel | |
| 2021/0270065 | A1 | 9/2021 | Reusch | |

FOREIGN PATENT DOCUMENTS

| | | | | |
|---|---|---|---|---|
| DE | 102004011798.5 | | 10/2005 | |
| DE | 102005004571 | A1 * | 8/2006 | E05D 13/1253 |
| DE | 102016107717 | A1 * | 10/2017 | E05B 47/0012 |
| EP | 0133508 | A1 * | 2/1985 | |
| EP | 0133508 | A1 * | 2/1985 | |
| EP | 1319780 | | 1/2005 | |
| EP | 1617021 | | 8/2007 | |
| WO | WO-0049252 | A1 * | 8/2000 | E05B 81/20 |
| WO | WO-2007090389 | A1 * | 8/2007 | E05B 81/22 |
| WO | 2020007409 | | 1/2020 | |

OTHER PUBLICATIONS

"Non-Final Office Action," for U.S. Appl. No. 16/039,854 dated May 11, 2021 (23 pages).
"Notice of Allowance," for U.S. Appl. No. 16/039,854 dated Feb. 15, 2022 (18 pages).
"Response to Non-Final Rejection," dated May 11, 2021 for U.S. Appl. No. 16/039,854, submitted via EFS-Web dated Nov. 11, 2021, 9 pages.

* cited by examiner

MOTOR VEHICLE LOCK

FIELD OF THE TECHNOLOGY

The disclosure is directed to a method for operating a motor vehicle lock, to a motor vehicle lock arrangement and to a motor vehicle door arrangement.

BACKGROUND

The motor vehicle lock in question is assigned to a motor vehicle door arrangement, which comprises at least a motor vehicle door. The expression "motor vehicle door" is to be understood in a broad sense. It includes in particular side doors, back doors, liftgates, trunk lids or engine hoods. Such a motor vehicle door may generally be designed as a sliding door as well.

In order to increase the user-friendliness during closing of the motor vehicle door, today's motor vehicle locks are often equipped with a so-called cinching function. The cinching function provides a motorized movement of the catch of a motor vehicle lock from its preliminary latching position into its main latching position, which goes along with pulling the respective motor vehicle door from a preliminary door position into a main door position. This very last part of the closing movement of the motor vehicle door requires a considerable force against the door seals. This is why the cinching function is to be considered an important comfort feature.

The known motor vehicle lock (EP 1 617 021 B1), which is the starting point for the disclosure, represents a possible realization of the above noted cinching function. According to this it is known that the motor vehicle lock is provided with a cinching element and a cinching drive, such that, during a cinching routine, the catch may be moved into its main latching position by the cinching drive via the cinching element. The cinching routine is initiated by a manual movement of the catch into the preliminary latching position. This manual movement of the catch into its preliminary latching position goes back on the user moving the motor vehicle door manually into the preliminary door position.

While normally the above noted cinching function increases the user-friendliness in a very intuitive way, the cinching function also comprises a certain risk of injury. The reason for this is the fact that with the catch in its preliminary latching position, a certain gap between the motor vehicle door and the motor vehicle body remains. In case an object, finger or the like has been inserted into the gap, the full cinching force is applied to such means. This generally decreases the operational safety of the motor vehicle lock in question.

SUMMARY

It is therefore an object of some embodiments of the disclosure to improve the known motor vehicle lock such that the operational safety of the cinching function is increased with low constructional effort.

The above noted object is solved for a method as described herein.

The idea underlying the disclosure is to integrate a spring biased freewheel mechanism into the flux of force between the cinching drive and the catch in such a way, that a freewheel distance has to be overcome against the spring bias of the freewheel mechanism, before the freewheel mechanism interlocks and transfers large cinching forces. In case a user inserts a finger into the gap between the motor vehicle door and the motor vehicle body during the beginning of the cinching routine, the freewheel distance is run through against the spring bias of the freewheel mechanism. This means that during running through the freewheel distance the finger of the user experiences only those relatively low forces, which go back on the spring bias of the freewheel mechanism. Only after running through the freewheel distance, the full cinching forces are being applied to the door as the freewheel mechanism is being interlocked by that time. Being warned by the increasing but still relatively low force being exercised on its finger, the user will most probably pull out his finger before the time in which the freewheel mechanism is being interlocked.

In further detail it is proposed that between the cinching drive and the catch, a spring biased freewheel mechanism, which is limited to a freewheel distance, is provided. With the reaction force of the catch, which may go back on an object like a finger being inserted into the gap between the motor vehicle door and the motor vehicle body, exceeding a predefined level the cinching drive freewheels with respect to the catch against the spring bias of the freewheel mechanism, until the freewheel distance is reached and the freewheel mechanism is interlocked for force transmission. The proposed solution is an easy to realize way for warning the user that the cinching routine is running. This warning is done by running through the freewheel distance against the spring bias of the freewheel mechanism, such that the user has time to dissolve the collision situation, for example by pulling out his finger out of the gap between the motor vehicle door and the motor vehicle body.

In some embodiments, in the mounted state, the catch being moved from the preliminary latching position into the main latching position, corresponds to the gap between the motor vehicle door and the motor vehicle body decreasing from a preliminary gap to no gap. This means that the main latching position of the catch corresponds to the fully closed motor vehicle door.

The size of the preliminary gap is between 4 mm and 8 mm according to some embodiments, which may easily be closed by the cinching drive, which, however, also imposes a certain risk of a user inserting a finger into the gap.

According to various embodiments the predefined level of reaction force produced by the catch corresponds to a relatively low cinching force between the motor vehicle door and the motor vehicle body of less than 50 N and further of less than 20 N. This force is particularly low, taking into account that the maximum cinching force between the motor vehicle door and the motor vehicle body is between 250 N and 400 N.

Various embodiments are directed to the freewheel mechanism. According to some embodiments this freewheel mechanism is based on a pivotable force transmission lever, which pivot axis may be deflected against the spring bias of the freewheel mechanism. This kind of realization of the freewheel mechanism is particularly robust, as the force transmitting means are designed as pivotable means.

Various other embodiments are also directed to the freewheel mechanism. In this second embodiment the freewheel mechanism comprises two force transmission elements, that are coupled to each other with a play to the extend of the freewheeling distance, wherein both force transmission elements are spring biased against each other. This second embodiment is particularly easy to realize as a spring biased play requires only few components. According to some embodiments, the force transmission elements may be moved against each other along a linear path, which can be advantageous in view of integrating the freewheel mechanism into the drive train between the cinching drive and the catch. This can be particularly true for the various embodiments, in which at least one force transmission element is coupled to a bowden cable arrangement, which bowden cable arrangement provides the drive connection between the cinching drive and the catch.

The further embodiments are directed to the drive train between the cinching drive and the catch being designed as a self-locking drive train. The self-locking drive train can be advantageous in mechanical view, however, it can impose an additional risk of injury, as the motor vehicle door does not swing open in case of a loss of battery power or the like.

It may be pointed out that the cinching drive may be an integral part of the proposed motor vehicle lock. In some embodiments, this means that the motor vehicle lock comprises a housing which receives the cinching drive besides all other lock components. However, the cinching drive may also be realized separately from the motor vehicle lock. For example, the cinching drive may be drivingly connected to the motor vehicle lock by a bowden cable arrangement.

Various embodiments are directed to a motor vehicle lock arrangement as such. Here it is of particular importance that the motor vehicle lock and the cinching drive are both part of the motor vehicle lock arrangement. As noted above the cinching drive may be an integral part of the motor vehicle lock or may be realized separately from the motor vehicle lock.

Various embodiments include a motor vehicle door arrangement with a motor vehicle door and a motor vehicle lock arrangement as described herein. All explanations given with regard to the previous embodiments may be applied to all other embodiments.

Various embodiments provide a motor vehicle lock with a catch and a pawl, which is assigned to the catch, wherein the catch may be moved into an open position, into a preliminary latching position and into a main latching position, wherein the catch, which is in one of the latching positions, is or may be brought into holding engagement with a lock striker, wherein the pawl may be moved into an engagement position, in which it is in blocking engagement with the catch, and wherein the pawl may be moved into a release position, in which it releases the catch, wherein in the installed state, during a cinching routine, the catch is being moved into its main latching position by a cinching drive, wherein that between the cinching drive and the catch a spring biased freewheel mechanism, which is limited to a freewheel distance, is provided, that with the reaction force of the catch exceeding a predefined level the cinching drive freewheels with respect to the catch against the spring bias of the freewheel mechanism, until the freewheel distance is reached and the freewheel mechanism is interlocked for force transmission.

In various embodiments, in the mounted state, with the catch being moved from the preliminary latching position into the main latching position during the cinching routine, the gap between the motor vehicle door and the motor vehicle body decreases from a preliminary gap to no gap.

In various embodiments, the size of the preliminary gap is between 4 mm and 8 mm, such as 6 mm.

In various embodiments, in the installed state, the predefined level of reaction force produced by the catch corresponds to a pinching force between the motor vehicle door and the motor vehicle body of less than 50N, such as less than 20N.

In various embodiments, the freewheel mechanism comprises a force transmission lever, which is assigned a pivot bearing for pivoting around a pivot axis, wherein the pivot bearing of the force transmission lever comprises a play corresponding to the freewheel distance of the freewheel mechanism, which allows a translational deflection of the force transmission lever relative to the pivot axis and laterally with respect to the pivot axis or together with the pivot axis and laterally with respect to the pivot axis.

In various embodiments, the pivot bearing comprises a base section with a slot, which slot carries a bolt defining the pivot axis, wherein running through the freewheel distance corresponds to the bolt proceeding through the slot.

In various embodiments, the force transmission lever comprises a first lever arm, which in the installed state is connected to the cinching drive and that the force transmission lever comprises a second lever arm, which is connected to the catch during the cinching routine.

In various embodiments, during freewheeling, the reaction forces of the catch hold the second lever arm in place and the first lever arm is driven by the cinching drive, while the bolt is proceeding through the slot.

In various embodiments, the freewheel mechanism comprises a first force transmission element and a second force transmission element, that are coupled to each other with a play corresponding to the freewheeling distance and that the first force transmission element and the second force transmission element are spring biased against each other.

In various embodiments, the force transmission elements may be moved against each other along a linear path.

In various embodiments, in the installed state at least one force transmission element is coupled to a bowden cable arrangement.

In various embodiments, the drive train, that is assigned to the cinching drive, is designed as a self locking drive train.

Various embodiments provide a motor vehicle lock arrangement with a motor vehicle lock as described herein and a cinching drive connected to the motor vehicle lock.

Various embodiments provide a motor vehicle door arrangement with a motor vehicle door and a motor vehicle lock arrangement as described herein.

BRIEF DESCRIPTION OF THE DRAWINGS

In the following the disclosure will be described in an example referring to the drawings.

In the drawings.

DETAILED DESCRIPTION

Figure 1:
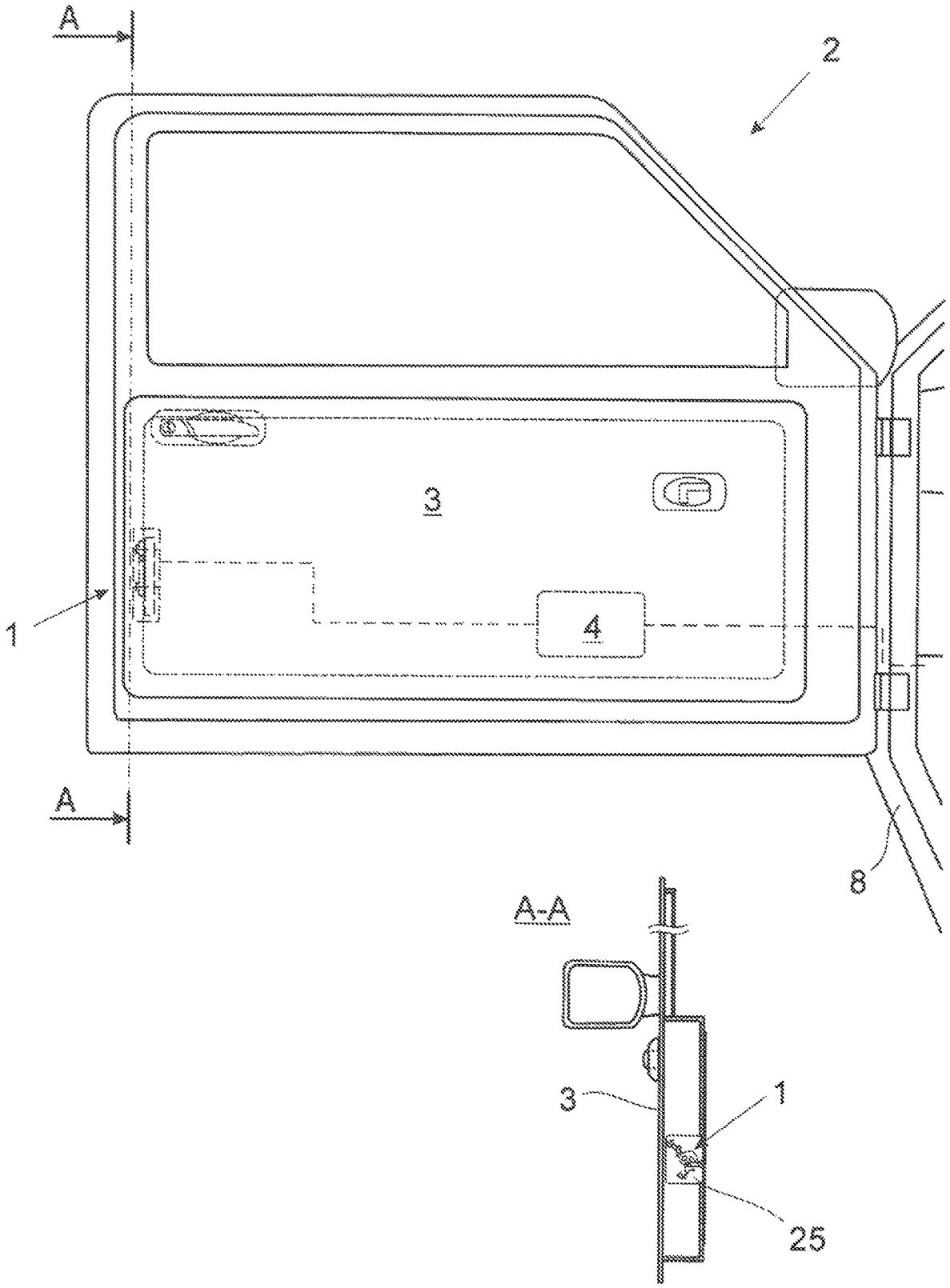
FIG. 1 illustrates a proposed motor vehicle door arrangement with a proposed motor vehicle lock arrangement including a proposed motor vehicle lock.

The motor vehicle lock 1 shown in the drawings is assigned to a motor vehicle door arrangement 2, which comprises a motor vehicle door 3 besides the motor vehicle lock 1. The motor vehicle lock 1 is designed for being operated by a lock control 4.

Regarding the broad interpretation of the expression "motor vehicle door" reference is made to the introductory part of this specification. Here, the motor vehicle door 3 is a side door of a motor vehicle.

Figure 2:
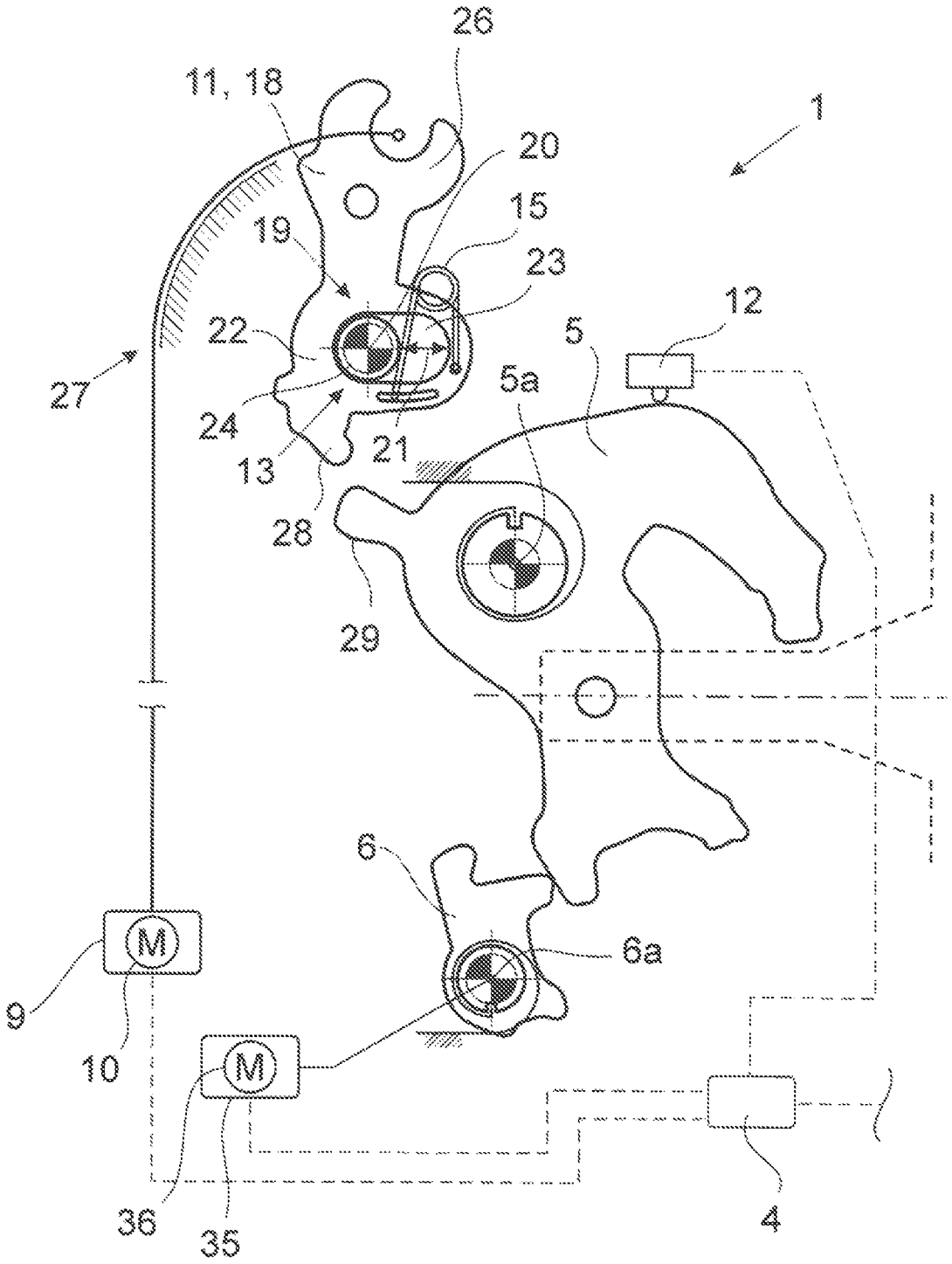
FIG. 2 illustrates the motor vehicle lock of FIG. 1 with the catch in its open position.
Figure 5:
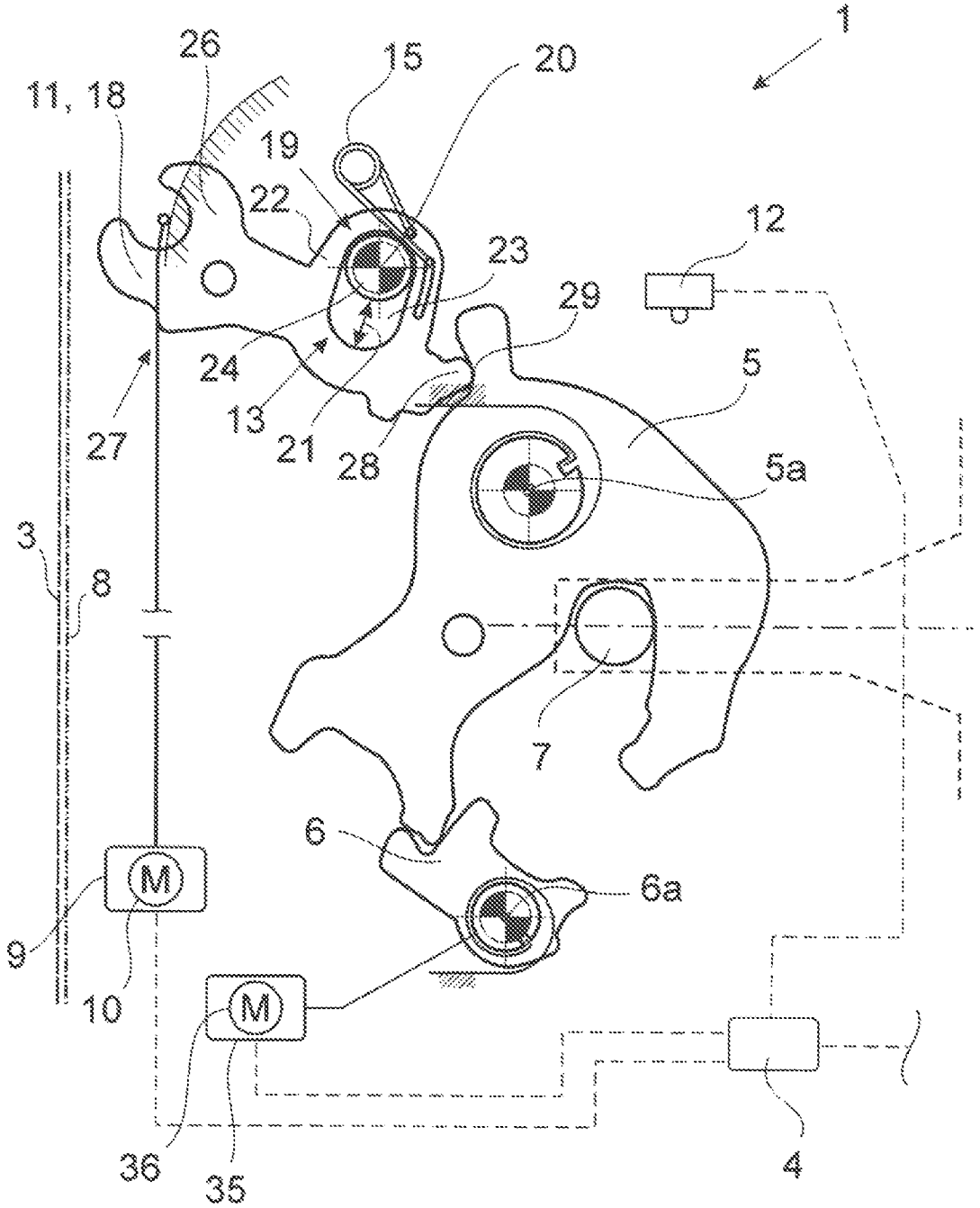
FIG. 5 illustrates the motor vehicle lock according to FIG. 1 in its main latching position and FIG. 6 illustrates another embodiment of the motor vehicle lock according to FIG. 1 during the cinching routine a) in normal operation and b) in a collision situation.

The motor vehicle lock 1 comprises the usual locking elements catch 5 and pawl 6, which pawl 6 is assigned to the catch 5. The catch 5 may be moved into an open position (FIG. 2), into a preliminary latching position (FIG. 3) and into a main latching position (FIG. 5). The catch 5, which is in one of the latching positions, is or may be brought into holding engagement with a lock striker 7, as is shown in FIG. 5 for the example of the main latching position of the catch 5.

Here, the motor vehicle lock 1 is arranged on the motor vehicle door 3, while the lock striker 7 is arranged on the motor vehicle body 8. This may be realized the other way around as well.

Figure 3:
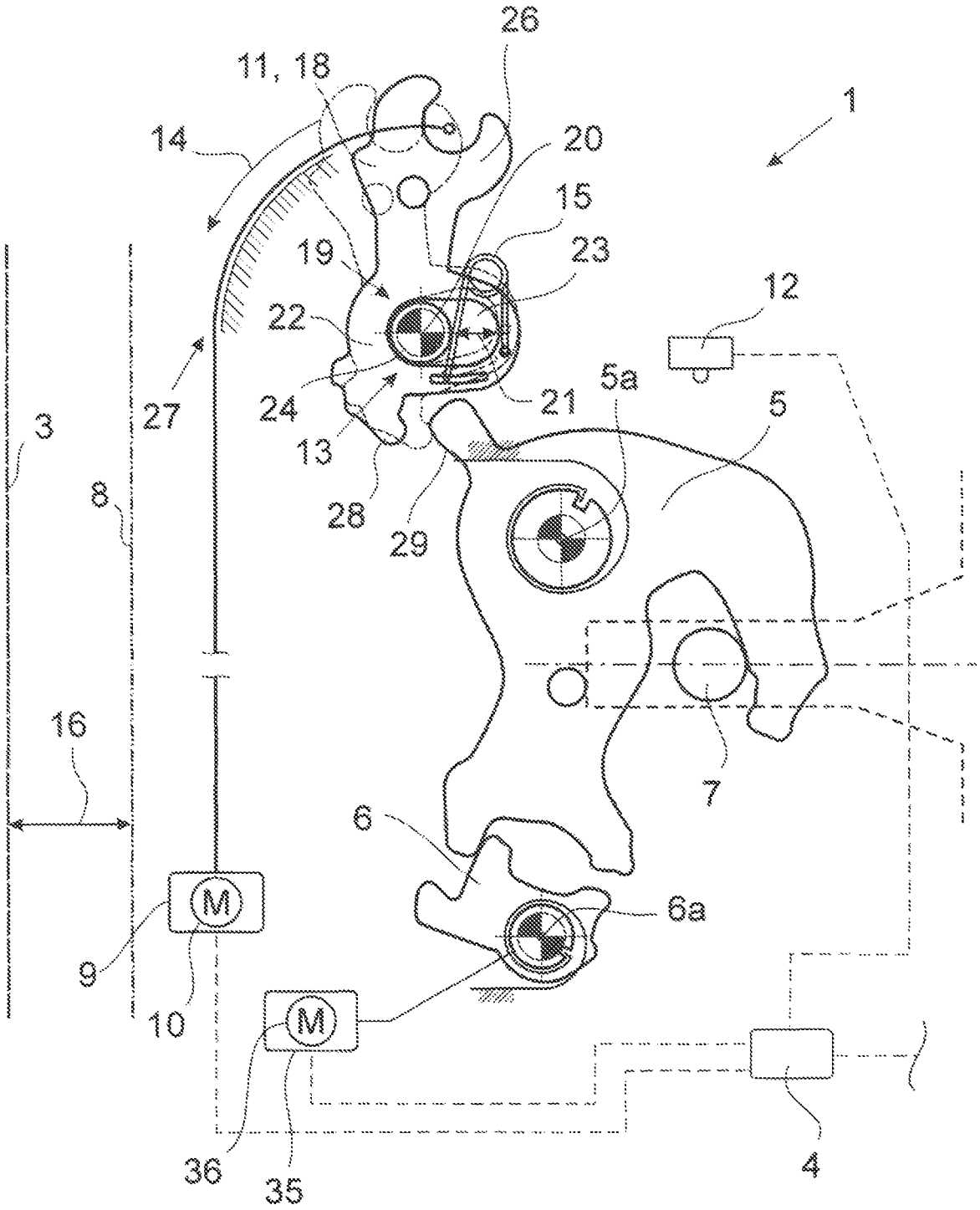
FIG. 3 illustrates the motor vehicle lock according to FIG. 1 with the catch in its preliminary latching position.

The pawl 6 may be moved into an engagement position, which is shown in FIG. 3 for the preliminary latching position and in FIG. 5 for the main latching position. In the engagement position, the pawl 6 is in blocking engagement with the catch 5, preventing the catch 5 from moving into its opening direction. In addition, the pawl 6 may be moved into a release position, in which it releases the catch 5, freeing the catch 5 to a movement into its opening direction. The wording "blocking engagement" is to be understood in a broad sense. It means that the pawl 6 is able to hold the catch 5 in its respective latching position. This can also include that the pawl 6 itself has to be engaged by another pawl in order to hold the catch 5 in its respective latching position.

Here the catch 5 is pivotable around the catch axis 5*a*, while the pawl 6 is pivotable around the pawl axis 6*a*. Generally there are other possibilities for realizing the movement of catch 5 and/or pawl 6.

For realizing the above noted cinching function, a cinching drive 9 is provided. The cinching drive 9 may be integrated into the motor vehicle lock 1. As an alternative, the cinching drive 9 may be realized separately from the motor vehicle lock 1. In this alternative, the cinching drive 9 may be drivingly coupled to the motor vehicle lock 1, in particular to the catch 5, via a bowden cable arrangement or the like.

In any case, the catch 5 has to be drivingly coupled to the cinching drive 9, such that the catch 5 may be driven by the cinching drive 9 during a cinching routine.

Here the cinching drive 9 is designed as a motorized drive. Accordingly, the cinching drive 9 can include a cinching motor 10, which further can be realized as an electric motor. The electric motor can further include a rotational output shaft, which is drivingly coupled to a cinching element 11, which transmits the force generated by the cinching drive 9 to the catch 5.

During the cinching routine, the catch 5 is being moved into its main latching position by the cinching drive 9 via the cinching element 11. For this, the cinching element 11 engages the catch 5, as may be taken from the transition of FIG. 4 to FIG. 5. In some embodiments, the cinching routine includes moving the catch 5 from its preliminary latching position into its main latching position by the cinching drive 9.

In some embodiments, the cinching routine is initiated in a very intuitive way. In detail, a manual movement of the catch 5 from the open position into the preliminary latching position causes the cinching routine to be initiated by the lock control 4. The expression "manual movement" means, that the movement of the catch 5 in so far has been caused without the support of the cinching drive 9. This manual movement of the catch 5 accordingly goes back on a closing movement of the motor vehicle door 3 from an open door position, which corresponds to the open position of the catch 5, into a preliminary door position, which corresponds to the preliminary latching position of the catch 5.

The lock control 4 monitors if a manual movement of the catch 5 from the open position into the preliminary latching position has taken place and accordingly causes the cinching routine to be initiated. For this, the lock control 4 can be control-wise coupled to a catch sensor 12, which may be a simple micro switch or the like. Other possibilities for monitoring the catch movement are well applicable.

According to various embodiments, between the cinching drive 9 and the catch 5 a spring biased freewheel mechanism 13 is provided, which is limited to a freewheel distance 14. The freewheel mechanism 13 allows a cinching movement of the cinching drive 9 over the freewheel distance 14 without the catch 5 following this movement. After running through the freewheel distance 14 the freewheel mechanism 13 interlocks, which interlocked state of the freewheel mechanism 13 is shown in FIG. 5.

The above noted running through the freewheel distance 14 is performed against the spring bias of the freewheel mechanism 13. The spring bias goes back on a spring arrangement 15, which is assigned to the freewheel mechanism 13.

During the cinching routine, with the reaction force of the catch 5 exceeding a predefined level the cinching drive 9 freewheels with respect to the catch 5 against the spring bias of the freewheel mechanism 13, until the freewheel distance is reached and the freewheel mechanism is interlocked for force transmission. The sequence during normal operation may be taken from the sequence of FIGS. 3, 4*a* and 5.

The sequence of the cinching routine for a collision situation may be taken from the sequence of FIGS. 3, 4*b* and 5. Interesting is the fact that in FIG. 4*b* the cinching drive 9 drives the cinching element 11 in a counter-clockwise direction without the catch 5 being moved at all. This is because the catch 5 is being blocked by an object in the gap between the motor vehicle door 3 and the motor vehicle body 8, which object may be a finger of the user. As will be explained later, in this situation, the only force acting on the catch 5 and thereby on the motor vehicle door 3 is the force of the spring arrangement 15 shown in FIG. 4*b*. As a result, even in the collision situation, an injury of the finger of the user is very unlikely.

Generally, in the mounted state, with the catch 5 being moved from the preliminary latching position into the main latching position during the cinching routine, the gap 16 between the motor vehicle door 3 and the motor vehicle body 8 decreases from a preliminary gap (FIG. 3) to no gap (FIG. 5).

The gap 16 is indicated in the drawings with reference No. 16. The finger of the user is indicated in FIG. 4*b* with reference No. 17.

The size of the preliminary gap 16, which corresponds to the preliminary latching position of the catch 5, can be between 4 mm and 8 mm, such as 6 mm. This shows that generally the insertion of a finger 17 of the user imposes a risk of injury.

In the installed state, the predefined level of reaction force produced by the catch 5 can correspond to a pinching force between the motor vehicle door 3 and the motor vehicle body 8 of less than 50 N, such as less than 20 N. This means that during running through the freewheel distance the risk of injury for the user is considerably reduced. The level of reaction force may easily be adjusted to a desired value just by a corresponding design of the spring arrangement 15.

In the embodiment shown in FIGS. 2 to 5 the freewheel mechanism 13 comprises a force transmission lever 18, which is assigned to a pivot bearing 19 for pivoting around a pivot axis 20.

For freewheeling along the freewheel distance 14, the pivot bearing 19 of the force transmission lever 18 comprises a play 21 corresponding to the freewheel distance 14. The play 21 of the pivot bearing 19 allows a translational deflection of the force transmission lever 18 relative to the pivot axis 20 and naturally with respect to the pivot axis 20. In an alternative (not displayed), the pivot bearing 19 may be designed such that the play 21 allows a translational deflection of the force transmission lever 18 together with the pivot axis 20 and laterally with respect to the pivot axis 20.

As shown in FIGS. 2 to 5 the pivot bearing 19 comprises a base section 22 with a slot 23, which slot 23 carries a bolt 24 defining the pivot axis 20. The arrangement is such that running through the freewheel distance 14 corresponds to the bolt 24 proceeding through the slot 23. Here the base section 22 with the slot 23 is part of the force transmission lever 18, while the bolt 24 is fixed to the housing 25 of the motor vehicle lock 1.

The force transmission lever 18 can include a first lever arm 26, which in the shown installed state is connected to the cinching drive 9. This connection between the cinching drive 9 and the force transmission lever 18 is realized by a bowden cable arrangement 27, as indicated in the drawings as well.

Figure 4:
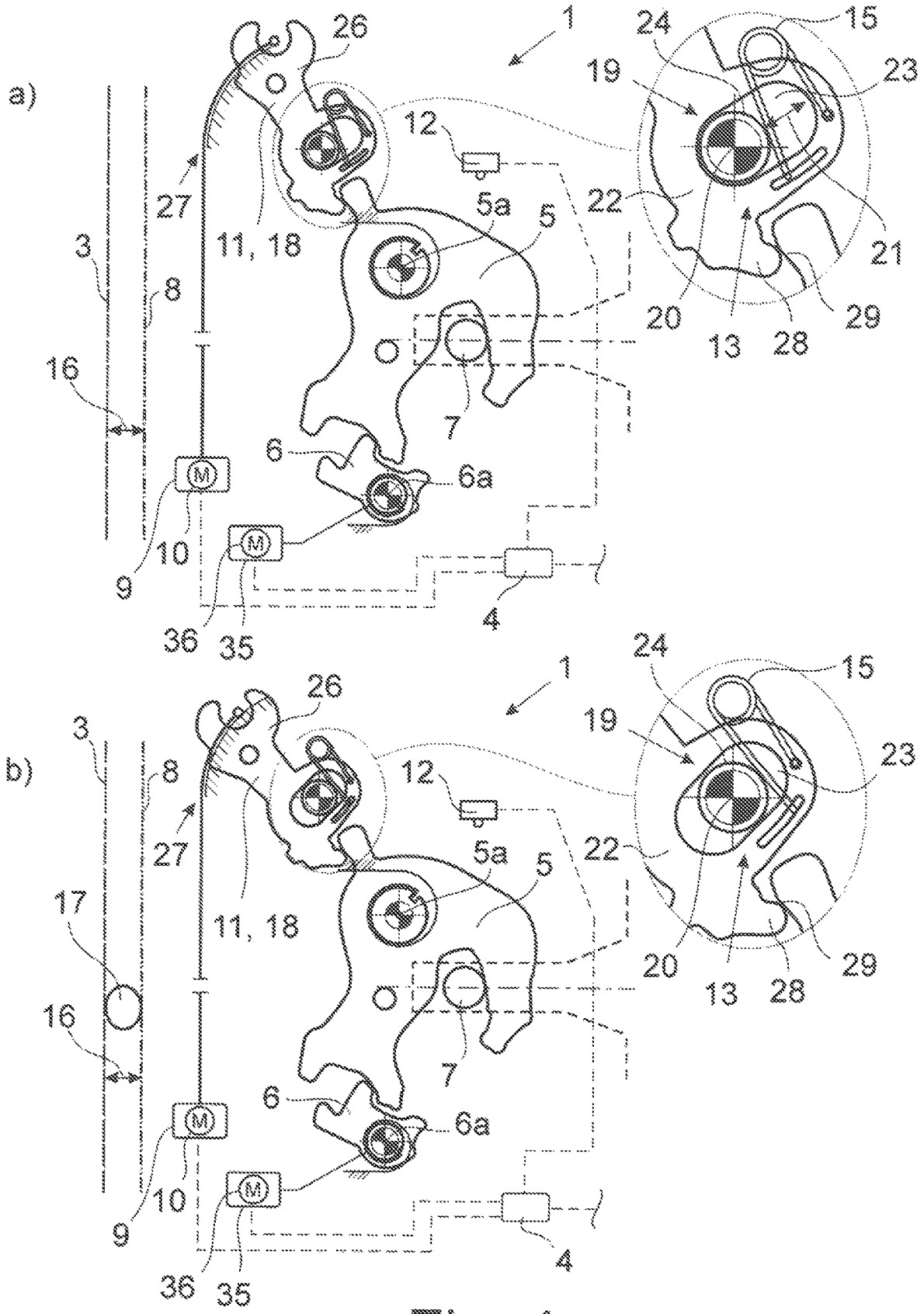
FIG. 4 illustrates the motor vehicle lock according to FIG. 1 during the cinching routine a) in normal operation and b) in a collision situation.
Figure 6:
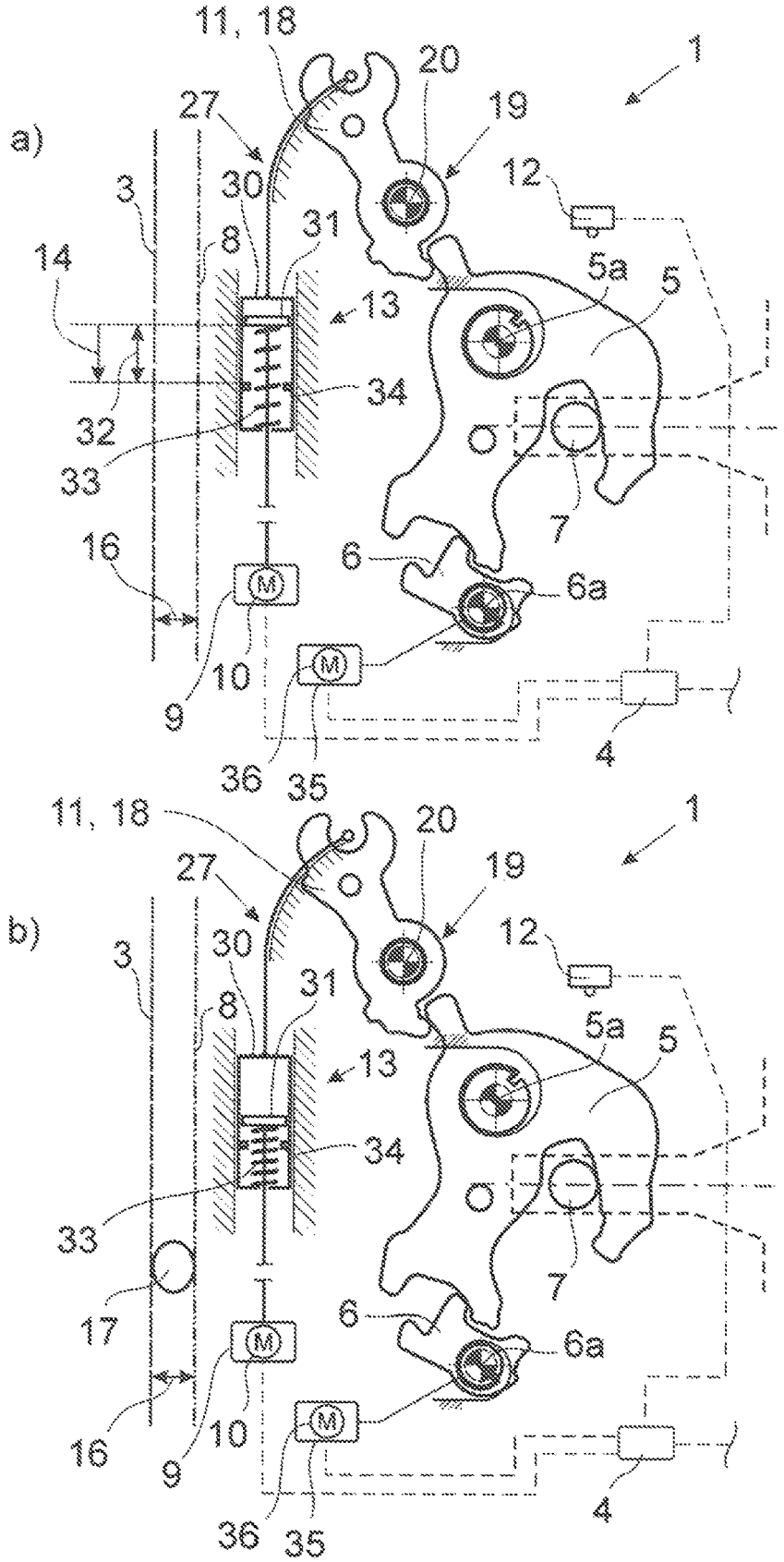

In addition, the force transmission lever 18 comprises a second lever arm 28, which is connected to the catch 5 during the cinching routine, as may be taken from FIGS. 4, 5 and 6. For this connection the catch comprises an engagement section 29 in the form of a nose, which is in the path of movement of the second lever arm 28 of the force transmission lever 18, at least when the catch 5 is in its preliminary latching position.

In the collision situation shown in FIG. 4*b*, during freewheeling, the reaction forces of the catch 5, which go back on the finger 17 inserted in gap 16 hold the second lever arm 28 in place, also the first lever arm 26 is still driven by the cinching drive 9, while the bolt 24 is proceeding through the slot 23. Until the bolt 24 reaches the end of the slot 23, the pinching force between the motor vehicle door 3 and the motor vehicle body 8 is generated only by the spring arrangement 15. Accordingly, if appropriately designed as noted above, the pinching during freewheeling is relatively low.

It is interesting that in the embodiment shown in FIGS. 2 to 5, the force transmission lever 18 fulfills exactly the function of the above noted cinching element 11. Here it becomes apparent that the freewheel mechanism 13 is integrated into the cinching element 11 which leads to an especially compact arrangement.

The second embodiment shown in FIG. 6 shows an identical behavior in view of the collision situation. The overall structure of the motor vehicle lock with the catch 5 and the pawl 6, the lock control 4 is identical to the first embodiment shown in FIGS. 2 to 4. However, the cinching element 11 is realized with a pivot bearing 19, that does not provide the play noted above.

In the embodiment shown in FIG. 6, the freewheel mechanism 13 is provided separately from the cinching element 11. In further detail, the freewheel mechanism 13 shown in FIG. 6 comprises a first force transmission element 30 and a second force transmission element 31, that are coupled to each other with a play 32 corresponding to the freewheeling distance 14. The first force transmission element 30 and the second force transmission element 31 are spring biased against each other by a spring arrangement 33. The result is that proceeding through the play i.e. freewheeling along the freewheeling distance 14 is possible only against the spring bias generated by the spring arrangement 33.

The force transmission elements 30, 31 shown in FIG. 6 may be moved against each other along a linear path, which makes it possible to integrate this freewheel mechanism 13 into an above noted bowden cable arrangement 27.

In further detail, FIG. 6*a* shows the normal operation of the motor vehicle lock 1 during the cinching routine. The freewheel distance 14 in this situation is yet to be run through. This will eventually take place when the motor vehicle door 3 engages the motor vehicle body 8 via the door seals.

FIG. 6*b* shows the collision situation, in which a finger 17 of a user has been inserted into the gap 16 between the motor vehicle door 3 and the motor vehicle body 8. Here, the reaction forces generated by the catch 5 are being transferred to the first force transmission element 30 via the cinching element 11. This means that the first force transmission element 30 stops its movement, although the cinching drive 9 is still generating a movement. During this movement the second force transmission element 31 is proceeding through the play 32 against the spring bias of the spring arrangement 33. This freewheeling is taking place until the freewheel mechanism 13 is interlocking. For this interlocking the first transmission element 30 comprises a blocking section 34, which blocks further movement of the second force transmission element 31, which leads to the freewheel mechanism 13 acting as a rigid force transmitting mechanism.

The drive train, that is assigned to the cinching drive 9, can be designed as a self-locking drive train. This means that backdriving the cinching drive by introducing a force into the catch 5 is not possible. Here the proposed solution is of utmost importance in order to reduce the risk of injury for the user.

According to another teaching the motor vehicle lock arrangement can comprise the motor vehicle lock 1 and the cinching drive 9 connected to the motor vehicle lock 1. Accordingly, all details given for the proposed method are fully applicable to this second teaching.

According to another teaching, which is of equal importance, the motor vehicle door arrangement 2 with a motor vehicle door 3 and the above noted motor vehicle lock arrangement is disclosed. Again, all details regarding the proposed method and regarding the proposed motor vehicle lock arrangement are fully applicable.

Just as a matter of completeness it may be pointed out, that in the opening direction of the catch 5, the positions of the catch 5 are arranged in the order of main latching position, preliminary latching position and open position.

Finally it may be pointed out that generally the pawl 6 may be moved into its release position by manual actuation forces by the user. Here, however, an opening drive 35 is provided, which comprises an opening motor 36 for motorized moving of the pawl 6 into its release position. The opening drive 35 is being controlled by the lock control 4 just as the cinching drive 9 noted above.

The invention claimed is:

1. A motor vehicle lock comprising:

a catch and a pawl, which is assigned to the catch, wherein the catch is configured to be moved into an open position, into a preliminary latching position and into a main latching position, wherein the catch, which is in one of the latching positions, is or may be brought into holding engagement with a lock striker, wherein the pawl is configured to be moved into an engagement position, in which it is in blocking engagement with the catch, and wherein the pawl may be moved into a release position, in which it releases the catch, wherein in an installed state, during a cinching routine, the catch is moved into the main latching position by a cinching drive via a cinching element, wherein the cinching element engages the catch during the cinching routine, wherein a spring biased freewheel mechanism, which is limited to a freewheel distance, is provided between the cinching drive and the catch, and wherein, with a reaction force of the catch exceeding a predefined level, when the cinching element is engaged with the catch during the cinching routine so that a cinching force is transmitted from the cinching element to the catch, the cinching drive freewheels with respect to the catch against the spring bias of the freewheel mechanism, until the freewheel distance is reached and the freewheel mechanism is interlocked for force transmission.

2. The motor vehicle lock according to claim 1, wherein, in the installed state, with the catch being moved from the preliminary latching position into the main latching position during the cinching routine, a gap between a motor vehicle door and a motor vehicle body decreases from a preliminary gap to no gap.

3. The motor vehicle lock according to claim 2, wherein the size of the preliminary gap is between 4 mm and 8 mm.

4. The motor vehicle lock according to claim 2, wherein the size of the preliminary gap is 6 mm.

5. The motor vehicle lock according to claim 1, wherein in the installed state, the predefined level of reaction force produced by the catch corresponds to a pinching force between a motor vehicle door and a motor vehicle body of less than 50 N.

6. The motor vehicle lock according to claim 1, wherein the freewheel mechanism comprises a force transmission lever, which is assigned a pivot bearing for pivoting around a pivot axis, wherein the pivot bearing of the force transmission lever comprises a play corresponding to the freewheel distance of the freewheel mechanism, which allows a translational deflection of the force transmission lever that is either relative to the pivot axis and laterally with respect to the pivot axis or together with the pivot axis and laterally with respect to the pivot axis.

7. The motor vehicle lock according to claim 6, wherein the pivot bearing comprises a base section with a slot, wherein the slot carries a bolt defining the pivot axis, wherein running through the freewheel distance corresponds to the bolt proceeding through the slot.

8. The motor vehicle lock according to claim 7, wherein the force transmission lever comprises a first lever arm, which in the installed state is connected to the cinching drive and wherein the force transmission lever comprises a second lever arm, which is connected to the catch during the cinching routine.

9. The motor vehicle lock according to claim 8, wherein during freewheeling, the reaction forces of the catch hold the second lever arm in connection with the catch and the first lever arm is driven by the cinching drive, while the bolt is proceeding through the slot.

10. The motor vehicle lock according to claim 1, wherein the freewheel mechanism comprises a first force transmission element and a second force transmission element, that are coupled to each other with a play corresponding to the freewheeling distance and wherein the first force transmission element and the second force transmission element are spring biased against each other.

11. The motor vehicle lock according to claim 10, wherein the force transmission elements may be moved against each other along a linear path.

12. The motor vehicle lock according to claim 10, wherein in the installed state at least one force transmission element is coupled to a bowden cable arrangement.

13. The motor vehicle lock according to claim 10, wherein a drive train that is assigned to the cinching drive is designed as a self locking drive train.

14. The motor vehicle lock according to claim 1, wherein in the installed state, the predefined level of reaction force produced by the catch corresponds to a pinching force between a motor vehicle door and a motor vehicle body of less than 20 N.

15. A motor vehicle lock arrangement comprising a motor vehicle lock according to claim 1 wherein the cinching drive is connected to the motor vehicle lock.

16. A motor vehicle door arrangement comprising a motor vehicle door and a motor vehicle lock arrangement according to claim 15.

* * * * *